US005744916A

United States Patent [19]

Kawabata et al.

[11] Patent Number: 5,744,916

[45] Date of Patent: Apr. 28, 1998

[54] DISCHARGE TUBE LIGHTING APPARATUS

[75] Inventors: Kenji Kawabata, Ome; Shuzo Matsumoto, Fujisawa; Ryuichi Ikeda, Yokohama; Motohiro Sugino, Fujisawa; Takashi Okada, Ome; Yoshiteru Watanabe, Sagamihara, all of Japan

[73] Assignee: International Business Machines Corporation, Armonk, N.Y.

[21] Appl. No.: 543,725

[22] Filed: Oct. 16, 1995

[30] Foreign Application Priority Data

Oct. 14, 1994 [JP] Japan ..... 6-249051

[51] Int. Cl.[6] ..... H05B 37/02

[52] U.S. Cl. ..... 315/308; 315/225; 315/DIG. 7; 315/308

[58] Field of Search ..... 315/82, 307, 225, 315/308, DIG. 7

[56] References Cited

U.S. PATENT DOCUMENTS

| | | | |
|---|---|---|---|
| 4,412,154 | 10/1983 | Klein | 315/225 |
| 5,140,229 | 8/1992 | Yagi et al. | 315/308 |
| 5,204,587 | 4/1993 | Mortimer et al. | 315/308 |
| 5,422,548 | 6/1995 | Yamashita et al. | 315/82 |

*Primary Examiner*—Robert Pascal
*Assistant Examiner*—Michael Shingleton
*Attorney, Agent, or Firm*—Ronald L. Drumheller

[57] ABSTRACT

In order to detect a fault which would result in heating or fuming of a discharge tube lighting circuit and to break the lighting circuit, input voltage and current are measured and multiplied to compute the input power. The discharge tube 3 is extinguished when an input power reaches a predetermined value.

4 Claims, 2 Drawing Sheets

DISCHARGE TUBE LIGHTING APPARATUS

BACKGROUND OF THE INVENTION

1. Field of the Invention

The present invention relates to a discharge tube lighting apparatus that uses an inverter to drive the discharge tube.

2. Related Art

As means for detecting a disorder of a discharge tube lighting apparatus, there is, for example, that of Japanese Patent Laid-Open Publication No. 112092/1991. To prevent transistors constituting a lighting circuit from being broken as a result of the overcurrent generated by an unlighted discharge tube or a burned-out discharge tube, the above-mentioned conventional discharge tube lighting apparatus uses an inverter which converts a DC power into a high-frequency power and supplies it to a load, a switching circuit being capable of ON duration of a switching element, the inverter comprising a protective circuit for detecting a current exceeding a predetermined value that flows in common through constituent parts and lowering the reference voltage for a decrease in said current in an inverter unit whose control circuit can control the ON period of a switching element in accordance with a set reference voltage. That is, it includes a circuit for monitoring a current flowing through the discharge tube and judging it abnormal when it exceeds a predetermined value.

Because the above background art monitors only the current of a discharge tube, it cannot in some cases detect a fault if the fault occurs some place other than in the discharge tube.

SUMMARY OF THE INVENTION

It is an object of the present invention to obtain a discharge tube lighting apparatus for detecting a fault that occurs in the whole discharge tube lighting apparatus, not only the discharge tube alone, and in particular a fault that is likely to cause overheating or fuming, and protecting the apparatus from it.

This object is achieved by providing a discharge tube lighting apparatus comprising: an inverter for converting the DC voltage of a DC power source into a high-frequency voltage and supplying it to the discharge tube; voltage measuring means for measuring an input voltage of said inverter; current measuring means for measuring an input current of said inverter; and multiplying means for computing the product of the measured result of said voltage measuring means and that of said current measuring means; wherein an output of said inverter is stopped or reduced when the computed result of said multiply means reaches to a predetermined value.

Also, in a discharge tube lighting apparatus that includes a DC-DC converter for changing an output voltage level of said DC power source before it is converted by an inverter into a high-frequency voltage for supply to the discharge tube, the above object is achieved by employing an input voltage and an input current of said DC-DC converter as the input voltage and input current that is measured.

Furthermore, the above object may be achieved by having the multiplying means stop or reduce the output of said DC-DC converter when the computed result reaches to a predetermined result.

The above object is achieved by having said predetermined value be a value that deviates from the range of power that occurs when said discharge tube is normally lighted, and by stopping or reducing the output of said inverter or DC-DC converter after the elapse of a predetermined time confirms the state of the computed result of the multiply means reaching a predetermined value.

When such a fault as might cause overheating or fuming occurs, higher energy is supplied generally for that reason alone, so that the input power in a discharge tube lighting apparatus increases above a normal value. Thus, by monitoring the input power to a discharge tube using voltage measuring means, current measuring means and multiply means, in order to compute the product of the measured results, the input power to the discharge tube may be stopped or reduced if it deviates from a normal value, thereby preventing overheating or fuming in advance when something is wrong.

BRIEF DESCRIPTION OF THE DRAWINGS

Embodiments of the present invention will be described now in connection with the accompanying drawings in which.

DETAILED DESCRIPTION OF THE PREFERRED EMBODIMENTS

Figure 1:
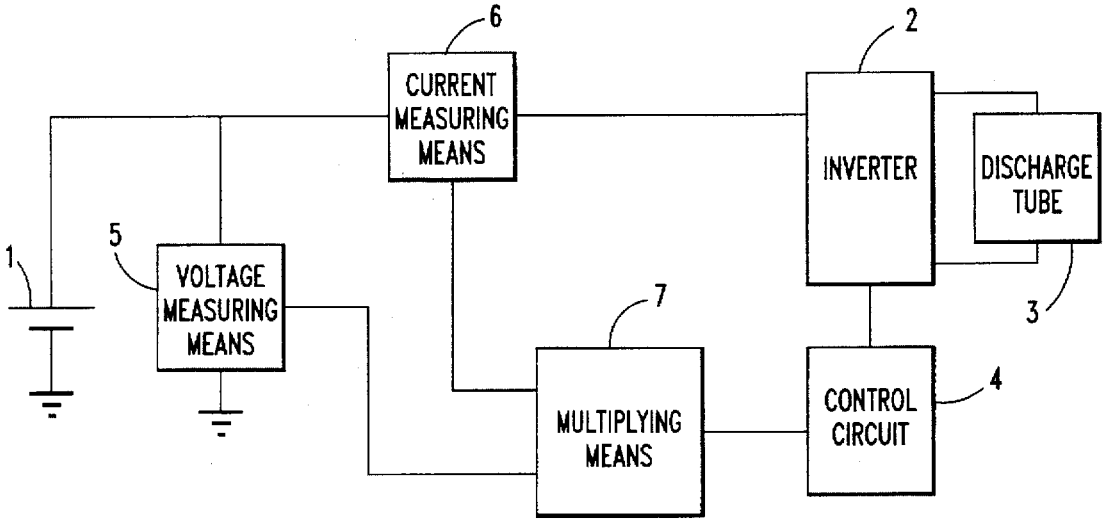
FIG. 1 is a block diagram showing a first embodiment of discharge tube lighting apparatus according to the present invention.

In FIG. 1 showing the configuration of a first embodiment, reference numerals 1, 2, 3, 4, 5, 6 and 7 denote a DC power source, an inverter, a discharge tube, a control circuit, voltage measuring means, current measuring means and multiply means, respectively. The above inverter 2 converts an output of the DC power source 1 into a high-frequency power and supplies it to the discharge tube 3. Hereby, the discharge tube 3 is lit with a high-frequency power but power required for lighting is supplied from the DC power source 1. Since voltage and current of a high-frequency power to be given to the discharge tube 3 is constant for a period during which the discharge tube 3 is lit in a normal state, the consumed power is determined uniquely. A value of power is, for example, expressed as that calculated by multiply means 7 from the measured results obtained by voltage measuring means 5 comprising an A/D converter and current measuring means 6 comprising a current detecting resistor and A/D converter. When an output of the above multiplying means 7 reaches a predetermined value, the control circuit 4 stops the operation of the inverter 2 and extinguishes the discharge tube 3. The predetermined value referred to here is one that deviates from the range of power used when the discharge tube 3 is normally lit. Thus, when the discharge tube 3 or some other part consumes a greater amount of power than ordinarily is needed, detection of a fault and prevention of overheating or fuming due to the quantity power consumed is enabled. To prevent misoperation due to a noise or the like, it is allowable that the control circuit 4 does not immediately stop the operation of the inverter 2 when the result of the multiply means 7 reaches a predetermined value, but rather stops operation of the inverter 2 only after the elapse of a predetermined time during which the multiplying means equals or exceeds the predetermined value. In this case, the time from detecting a fault to stopping the inverter 2 needs to be short enough that neither fuming nor combustion occurs from a faulty part. Also, it is allowable to reduce an output of the inverter 2 and to suppress the power only to such an extent that neither fuming nor combustion occurs. In this case, because the discharge tube 3 keeps on lighting, the fear of interrupting work is eliminated, for example, if the above discharge tube is used as a backlight for a liquid crystal display in terminal equipment.

Figure 2:
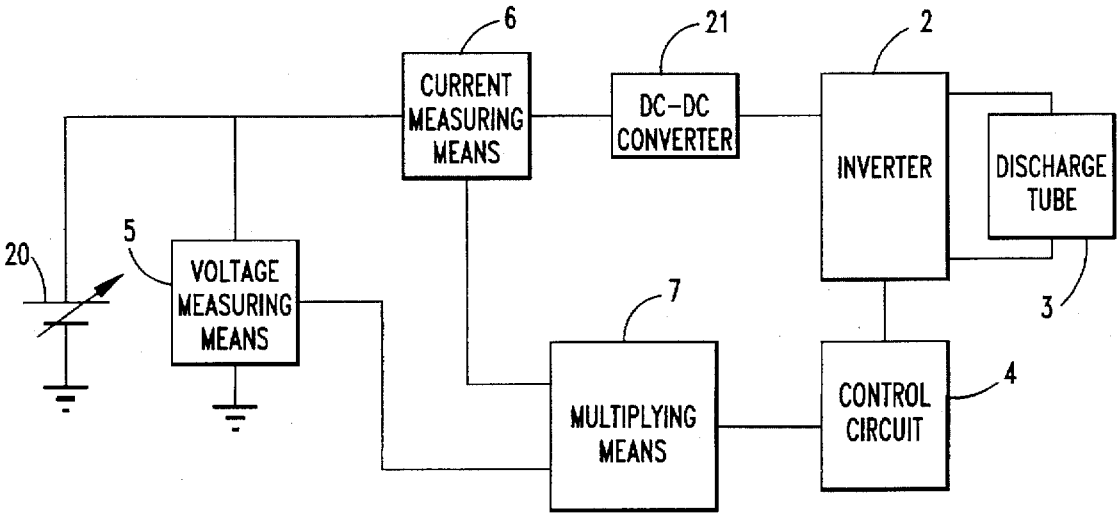
FIG. 2 is a block diagram showing a second embodiment of discharge tube lighting apparatus according to the present invention.

A second embodiment of the present invention will be described by referring to FIG. 2. In FIG. 2, reference numerals 20 and 21 denote a DC power source of varying output voltage and a DC-DC converter for converting an input DC voltage into a predetermined DC voltage, respectively. Otherwise, symbols similar to those of FIG. 1 are used in accordance with FIG. 1. An example of a case where the voltage of a power source varies as in this embodiment is where the source of power for a PC or the like is switched between a battery and an AC adapter. In this way, voltage to be supplied to an inverter 2 is kept constant under action of a DC-DC converter 21 even if the voltage of a power source varies. Also in this case, power consumed by the whole apparatus is almost constant regardless of any variation in voltage of a power source. Thus, monitoring the power to be supplied from a DC power source 20 by using voltage measuring means 5, current measuring means 6 and multiply means 7, enables a faulty circuit to be detected independently of voltage of a power source. Though the power is restricted or the light extinguished when detecting a fault through use of an inverter 2 in FIG. 2, the effect of the present invention would be unchanged if the DC-DC converter 21 were used instead for this purpose.

Figure 3:
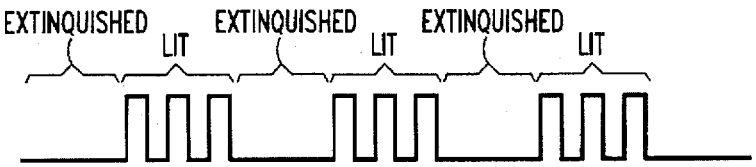
FIG. 3 is a graph showing a waveform of electric wave during dimming by pulse width modulation.

In addition, when dimming is performed by varying the current of a discharge tube 3, the measured value of current measuring means 6 naturally changes and therefore the consumed power also changes correspondingly. In this case, it is advisable to make the predetermined value correspond to the relevant degree of dimming in the control circuit 4. As means for dimming, there is a method for dimming a light by controlling a ratio between a lighting period and an extinguishing period by turning on and off the discharge tube 3 other than via the above means. However, the on-off period needs to be short enough so as to be not discernible to the naked eye. FIG. 3 shows a current flowing through the current measuring means 6 in this case. Since dimming is performed by turning the discharge tube 3 on and off in different ratios, the value of current during the period of lighting in FIG. 3 is constant independently of the degree of dimming when the circuit operates normally. Consequently, for this method of dimming, it is unnecessary to make the predetermined value variable in dependence on the degree of dimming if the apparatus is arranged to measure a peak value of current during the period of lighting.

Figure 4:
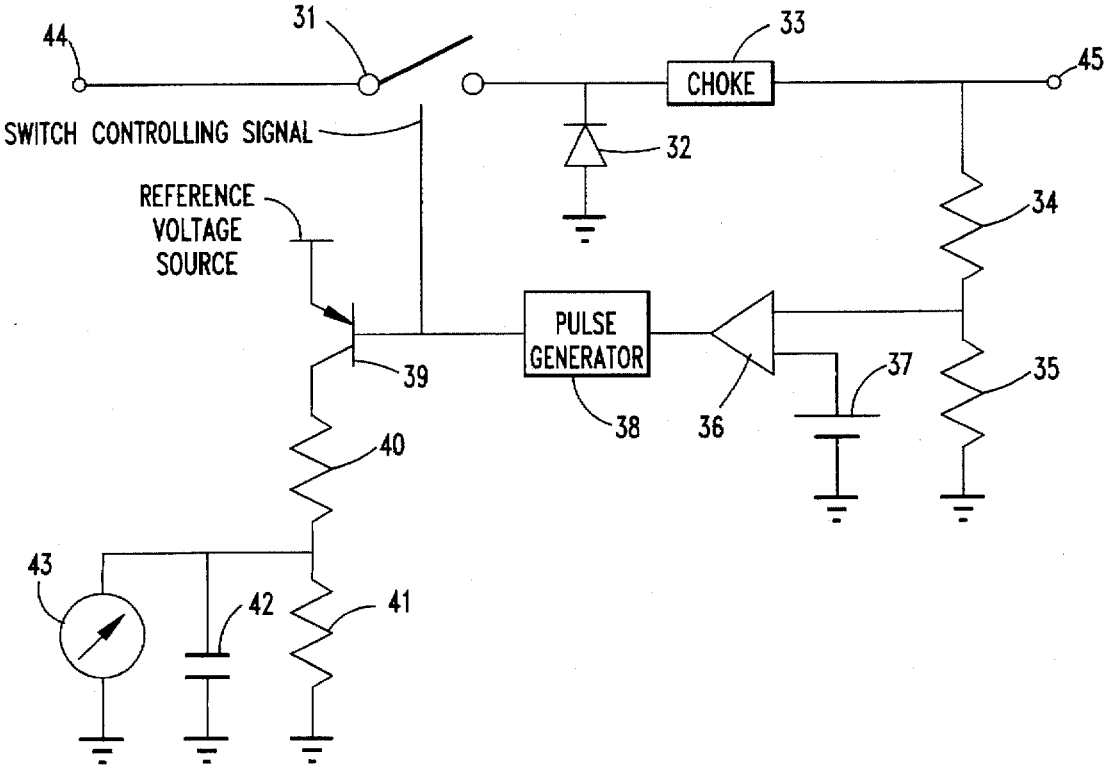
FIG. 4 is a block diagram showing another example of current measuring means.

Another example of a current measuring means will be described referring to FIG. 4. FIG. 4 shows a circuit of a DC-DC converter. In FIG. 4, reference numeral 31 denotes a switch element; 32 a diode; 33 a choke coil; 34, 35, 40 and 41 resistors; 36 an error detection amplifier; 37 a DC power source; 38 a pulse generator means; 39 a transistor; 42 a capacitor; 43 a voltage measuring means; 44 an input voltage terminal; and 45 an output voltage terminal. In FIG. 4, voltage to be generated at the output voltage terminal 45 is generated by turning the switch element 31 on and off with a pulse width modulated (PWM) control signal. With a longer OFF period, the energy stored in the choke coil 33 increases, thus raising the output voltage. A control signal is generated by pulse generator means 38. The error detection amplifier 36 detects an error of an output voltage divided by using the resistors 34 and 35 from that of the DC power source 37. The pulse generator means 38 controls the pulse width of a control signal so that the error detected by the error detection amplifier 36 may be minimized. By this operation, an output voltage of the above DC-DC converter is controlled to a value corresponding to the DC power source 37. In the case of the present invention, the load of the above DC-DC converter is a discharge tube and the consumed power thereof is constant without dimming. Thus, the pulse width of a control signal outputted from the pulse generator means 38 depends only on voltage applied to the input voltage terminal 44. That is, with higher voltage applied to the input voltage terminal 44, the width of a pulse for lowering the output voltage becomes shorter. On the contrary, with lower voltage applied to the input voltage terminal 44, the width of a pulse for lowering the output voltage becomes longer. And, since the power consumed at the output side of the DC-DC converter is constant, the input power becomes also constant, the input current decreases with higher input voltage and the input current increases with lower input voltage. That is, the pulse width of a control signal is nearly proportional to the input current. With this in mind, if a control signal is smoothed by using a transistor 39, resistors 40 and 41, and a capacitor 42 as shown in FIG. 4, the voltage observed after smoothing becomes nearly proportional to the input power. In order to measure a current at this voltage, the current can be measured without using a current-measuring resistor or transformer in the power supply line. Generally, when using a resistor and transformer in measuring the current, an amplifier is needed because of its small electromotive force, but a case of the above method requires no amplifier. In addition, the DC-DC converter is not limited to the configuration shown in FIG. 4 but those capable of controlling the voltage with a PWM signal can measure a value of current in a manner similar to the one mentioned above.

Multiplying a value of current by a value of voltage is performed using hardware in the above embodiments, but the effect of the present invention is unchangeable even if values of current and voltage are taken in a microcomputer after A/D conversion and a multiplication and fault detection is performed using software.

As described above, in a discharge tube lighting apparatus according to the present invention comprising: an inverter for converting the DC voltage of a DC power source into a high-frequency voltage and supplying it to a discharge tube; voltage measuring means for measuring an input voltage of said inverter; current measuring means for measuring an input current of said inverter; and multiply means for computing the product of the measured result of said voltage measuring means and that of said current measuring means, wherein an output of said inverter is stopped or reduced when the computed result of said multiply means reaches to a predetermined value, and a direct detection of the power consumed by a discharge tube lighting circuit leads to a rapid detection of a fault that consumes a greater amount of power than the normal and is likely to cause an overheat or fuming if occurring in the lighting circuit, so that the operation of the lighting circuit can be stopped.

We claim:

1. A discharge tube lighting apparatus comprising:

a circuit for powering a discharge tube, the circuit including an inverter for converting a DC voltage into a high-frequency voltage that powers the discharge tube;

voltage measuring means for measuring an input voltage to the circuit;

current measuring means for measuring an input current to the circuit; and multiply means responsive to the voltage measuring means and the current measuring means for computing the product of the measured input voltage and the measured input current; and means responsive to said multiply means for stopping said inverter when the product computed by said multiply means reaches and remains at or above a predetermined value for a predetermined period, said predetermined value corresponding to an input power used by said circuit which is above a range of input power used by said circuit when said discharge tube is normally operating.

2. The discharge tube lighting apparatus as set forth in claim 1, wherein the circuit includes a DC-DC converter responsive to a DC power source for supplying the DC voltage to the inverter, the input voltage and the input current to the circuit being an input voltage and an input current of said DC-DC converter.

3. A discharge tube lighting apparatus comprising:

a circuit for powering a discharge tube, the circuit including a DC-DC converter responsive to a DC power source for supplying a DC voltage and an inverter for converting the DC voltage supplied by the DC-DC converter into a high-frequency voltage that powers the discharge tube;

voltage measuring means for measuring an input voltage to the DC-DC converter;

current measuring means for measuring an input current to the DC-DC converter; and multiply means responsive to the voltage measuring means and the current measuring means for computing the product of the measured input voltage and the measured input current; and means responsive to said multiply means for reducing said DC voltage supplied by said DC-DC converter when the product computed by said multiply means reaches and remains at or above a predetermined value for a predetermined period, said predetermined value corresponding to an input power used by said circuit which is above a range of input power used by said circuit when said discharge tube is normally operating.

4. A discharge tube lighting apparatus comprising:

a circuit for powering a discharge tube, the circuit including a DC-DC converter responsive to a DC power source for supplying a DC voltage and an inverter for converting the DC voltage supplied by the DC-DC converter into a high-frequency voltage that powers the discharge tube;

voltage measuring means for measuring an input voltage to the DC-DC converter;

current measuring means for measuring an input current to the DC-DC converter; and multiply means responsive to the voltage measuring means and the current measuring means for computing the product of the measured input voltage and the measured input current; and means responsive to said multiply means for reducing said high-frequency voltage of said inverter when the product computed by said multiply means reaches and remains at or above a predetermined value for a predetermined period, said predetermined value corresponding to an input power used by said circuit which is above a range of input power used by said circuit when said discharge tube is normally operating.

* * * * *